US006520433B2

(12) United States Patent
Miura et al.

(10) Patent No.: US 6,520,433 B2
(45) Date of Patent: Feb. 18, 2003

(54) FUEL INJECTION VALVE

(75) Inventors: Takahiro Miura, Obu (JP); Hitoshi Asano, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 09/928,941

(22) Filed: Aug. 13, 2001

(65) Prior Publication Data

US 2002/0020770 A1 Feb. 21, 2002

(30) Foreign Application Priority Data

Aug. 11, 2000 (JP) ..... 2000-280944

(51) Int. Cl.[7] ..... B05B 1/30; F02M 51/00

(52) U.S. Cl. ..... 239/585.1; 239/533.11; 239/585.3; 239/585.4; 239/585.5; 251/129.19; 251/129.15

(58) Field of Search ..... 239/533.11, 585.1, 239/585.2, 585.3, 585.4, 585.5; 251/129.13, 129.17, 129.19, 129.15

(56) References Cited

U.S. PATENT DOCUMENTS 4,766,405 A * 8/1988 Daly et al. ..... 335/258
4,878,650 A * 11/1989 Daly et al. ..... 251/129.15
5,645,226 A * 7/1997 Bright ..... 239/585.1
5,667,194 A * 9/1997 Barron ..... 251/129.01
6,318,646 B1 * 11/2001 Mattioli et al. ..... 239/585.1
6,363,915 B1 * 4/2002 Cohen ..... 239/533.11
6,367,769 B1 * 4/2002 Reiter ..... 239/585.5

* cited by examiner

*Primary Examiner*—Robin O. Evans
(74) *Attorney, Agent, or Firm*—Baker Botts L.L.P.

(57) ABSTRACT

A fuel injection valve is capable of minimizing the waste of fuel and variations in the air-fuel ratio by weakening a water hammer action occurring as a result of sudden closing of a needle valve and thus suppressing the occurrence of a bouncing phenomenon. A water hammer absorbing member is provided between an armature and an injection hole to absorb and damp a water hammer pressure wave produced by sudden closing of the needle valve. Therefore, it is possible to reduce the pressure wave propagated to the armature, to which the needle valve is integrally secured, and hence possible to reduce the amount of lift of the needle valve due to a bouncing phenomenon. Accordingly, the amount of fuel excessively discharged is reduced. Thus, it becomes possible to minimize the waste of fuel and variations in the air-fuel ratio.

1 Claim, 4 Drawing Sheets

FUEL INJECTION VALVE

BACKGROUND OF THE INVENTION

The present invention relates to a fuel injection valve for use in an internal combustion engine. More particularly, the present invention relates to a structure for ensuring a correct fuel injection quantity by minimizing the water hammer action of fuel pressure occurring in the fuel injection valve.

A direct-injection engine in which high-pressure fuel is injected directly into the combustion chamber of the engine from a fuel injection valve is known. In such a direct-injection engine, stratified combustion is used during low-load conditions. The stratified combustion uses an air/fuel charge consisting mainly of a lean mixture and a small layer of rich mixture localized in the vicinities of the ignition plug to improve ignitability. In the stratified combustion, the fuel is injected into the combustion chamber during the compression stroke. In other words, the fuel is injected when the pressure in the combustion chamber is high. Accordingly, the pressure of fuel sent to the fuel injection valve is extremely higher than in the case of the conventional intake-manifold injection engines. That is, the pressure of fuel when injected is about 20 Mpa. When the needle valve is fully closed to stop the fuel injection, the pressure of fuel is as high as about 80 Mpa.

SUMMARY OF THE INVENTION

Accordingly, as shown in FIG. 7, when a fuel injection valve 21 shifts from a position in which a needle valve 14 is fully open to perform fuel injection to a position in which the needle valve 14 is fully closed to stop the fuel injection, a water hammer action occurs in the fuel injection valve 21 as a result of the sudden closing of the needle valve 14. This produces a high-pressure wave that goes upstream in the fuel injection valve 21 and acts on the distal end surface 13*a* of an armature 13 in such a manner as to lift the armature 13, causing the needle valve 14 to move in the direction in which it opens. That is, a bouncing phenomenon occurs. As shown in FIG. 6, the bouncing phenomenon includes a primary bounce (shown by A in the figure), a secondary bounce (shown by B in the figure) and a tertiary bounce (shown by C in the figure), which occur successively. Then, the bouncing phenomenon gradually attenuates to subside. During the bouncing phenomenon, fuel is undesirably discharged when the needle valve 14 opens. Therefore, the amount of fuel discharged in the total period of time that the needle valve 14 is open is added to a predetermined fuel discharge quantity. Accordingly, the total fuel discharge quantity becomes slightly larger than a predetermined value. This causes waste of fuel and variations in the air-fuel ratio.

Accordingly, an object of the present invention is to provide a fuel injection valve capable of minimizing the waste of fuel and variations in the air-fuel ratio by damping the high-pressure wave produced by the water hammer action and thus suppressing the occurrence of the bouncing phenomenon.

To attain the above-described object, the present invention provides a fuel injection valve wherein a needle valve integrally secured to an armature is lifted by excitation of an electromagnetic coil to inject fuel into a combustion chamber from an injection hole formed in a nozzle. In the fuel injection valve, a water hammer absorbing member is provided between the armature and the injection hole to absorb a water hammer pressure wave produced by sudden closing of the needle valve.

The water hammer absorbing member may be a metallic sheet formed in the shape of a polygonal cylinder having a fin at each vertex thereof.

The water hammer absorbing member may be a metallic mesh wound a plurality of turns into a circular cylinder.

The water hammer absorbing member may be a synthetic rubber formed in the shape of a circular cylinder.

The water hammer absorbing member may be a spongy elastic material formed in the shape of a circular cylinder.

In addition, the present invention provides a fuel injection valve having an injection hole formed at the distal end of a nozzle secured to a body and a valve portion formed at the distal end of a needle valve secured to an armature. The valve portion of the needle valve is urged toward the injection hole by resilient force exerted by a spring. The valve portion of the needle valve is lifted away from the injection hole by magnetic force produced by an electromagnetic coil. In the fuel injection valve, an annular plate is sandwiched between the body and the nozzle to define a space in the nozzle. Further, a water hammer absorbing member for absorbing a water hammer pressure wave is fitted in the space in the nozzle in such a manner that the water hammer absorbing member is kept out of contact with the needle valve.

With the above-described arrangement, the present invention provides the following advantageous effects.

A high-pressure wave produced by a water hammer action is absorbed and damped by the water hammer absorbing member. Therefore, it is possible to reduce the pressure wave propagated to the armature and hence possible to reduce the amount of lift of the needle valve due to a bouncing phenomenon. Accordingly, the amount of fuel excessively discharged is reduced. Thus, it becomes possible to minimize the waste of fuel and variations in the air-fuel ratio.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1:
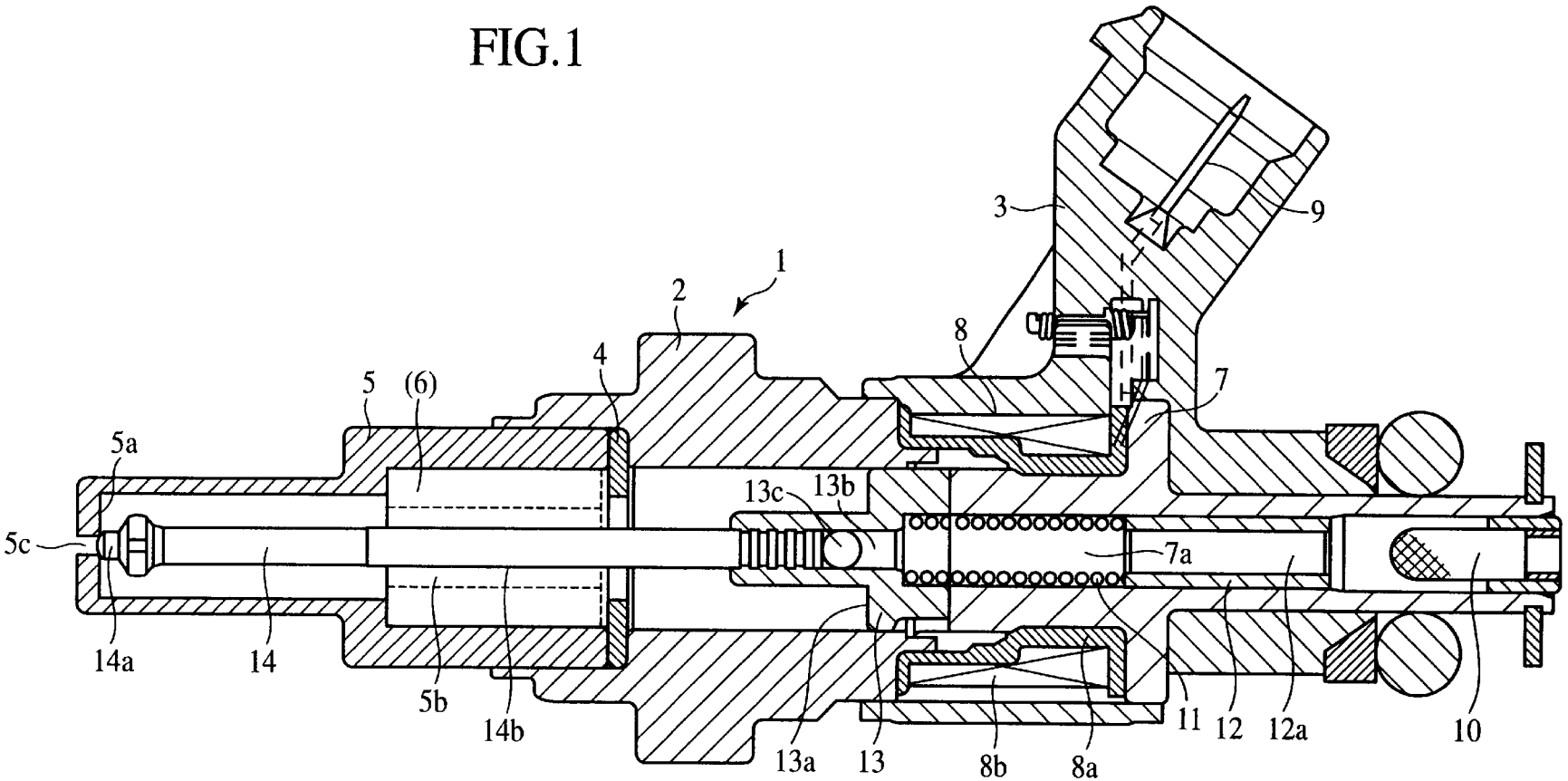
FIG. 1 is a longitudinal sectional view of a fuel injection valve according to one embodiment of the present invention.

Preferred embodiments of the present invention will be described below with reference to the accompanying drawings. FIG. 1 is a longitudinal sectional view of a fuel injection valve according to one embodiment of the present invention. In FIG. 1, a fuel injection valve 1 has a body 2 and a connector 3 secured to the upstream side (right-hand side in the figure) of the body 2. The connector 3 is made of a synthetic resin material. A metallic nozzle 5 is secured to the downstream side (left-hand side in the figure) of the body 2. The nozzle 5 constitutes a valve seat 5*a*. A plate 4 is sandwiched between the body 2 and the nozzle 5 to define a space 5*b*. A water hammer absorbing member 6 (described later) is fitted in the space 5*b*. The connector 3 has a metallic stator 7 and a coil subassembly 8 integrated therewith by simultaneous molding process. The stator 7 constitutes a fuel passage and also forms a magnetic path. The coil subassembly 8 excites the stator 7. The coil subassembly 8 comprises a bobbin 8*a* and a coil 8*b* wound on the bobbin 8*a*. One end of the coil 8*b* is connected to a metallic terminal 9 that is integrated with the connector 3 by simultaneous molding process. The other end of the coil 8*b* is grounded.

The stator 7 has a fuel passage 7*a* extending through the center thereof. A filter 10 is fitted in the inlet of the fuel passage 7*a* to remove dust from fuel. A retainer 12 is press-fitted in the fuel passage 7*a* at the downstream side of the filter 10 to support a spring 11. The retainer 12 has a fuel passage 12*a* extending through the center thereof. One end of the spring 11 is supported by the downstream end of the retainer 12. An armature 13 abuts on the other end of the spring 11. Thus, the armature 13 is constantly pressed by the spring 11. A needle valve 14 is integrally secured to the armature 13. The armature 13 has a fuel passage 13*b* extending through the center thereof. The fuel passage 13*b* is communicated with the space 5*b* through a communicating hole 13*c*. The needle valve 14 has a valve portion 14*a* formed at the downstream end (distal end) thereof. The valve portion 14*a* abuts on a valve seat 5*a* at the distal end of the nozzle 5 to close an injection hole 5*c*. The fuel injection valve 1 is arranged so that when the valve portion 14*a* abuts on the valve seat 5*a*, a slight gap is ensured between the armature 13 and the stator 7.

Figure 2:
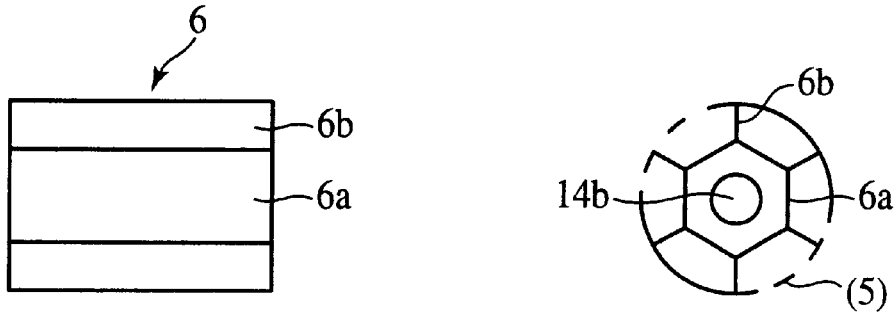
FIG. 2 shows side and sectional views of a water hammer absorbing member according to a first embodiment of the present invention.

FIG. 2 shows side and sectional views of a water hammer absorbing member according to a first embodiment of the present invention. In FIG. 2, a water hammer absorbing member 6 has a hexagonal cylinder 6*a* formed in the center thereof from a metallic sheet. The hexagonal cylinder 6*a* has radial fins 6*b* provided at the six vertices, which are formed from the same material as the cylinder 6*a*. The outer end of each fin 6*b* contacts the inner surface of the space 5*b* in the nozzle 5. The water hammer absorbing member 6 is installed in such a manner that a needle portion 14*b* of the needle valve 14 extends through the center of the hexagonal cylinder 6*a*. It should be noted that the cylindrical shape of the water hammer absorbing member 6 is not necessarily limited to the hexagonal configuration. The water hammer absorbing member 6 exhibits similar advantageous effects as long as it has a polygonal shape.

Figure 3:
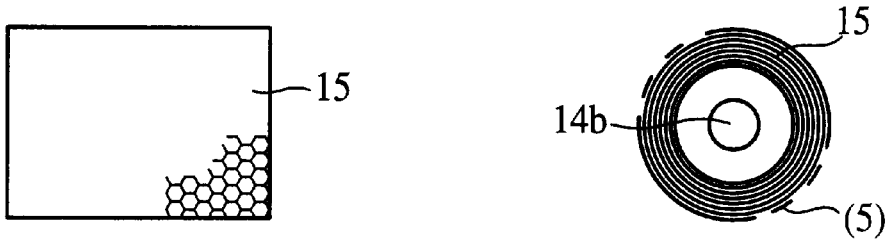
FIG. 3 shows side and sectional views of a water hammer absorbing member according to a second embodiment of the present invention.

FIG. 3 shows side and sectional views of a water hammer absorbing member according to a second embodiment of the present invention. In FIG. 3, a water hammer absorbing member 15 is formed in the shape of a circular cylinder by winding a net- or cutter foil-like metallic mesh a plurality of turns into a roll. The water hammer absorbing member 15 is installed in such a manner that the needle portion 14*b* of the needle valve 14 extends through the center of the cylindrical configuration of the water hammer absorbing member 15.

Figure 4:
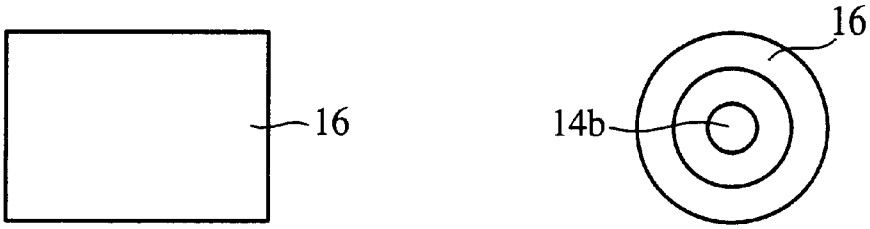
FIG. 4 shows side and sectional views of a water hammer absorbing member according to a third embodiment of the present invention.

FIG. 4 shows side and sectional views of a water hammer absorbing member according to a third embodiment of the present invention. In FIG. 4, a water hammer absorbing member 16 is a synthetic rubber member formed in the shape of a circular cylinder. The water hammer absorbing member 16 is installed in such a manner that the needle portion 14*b* of the needle valve 14 extends through the center of the cylindrical configuration of the water hammer absorbing member 16.

Figure 5:
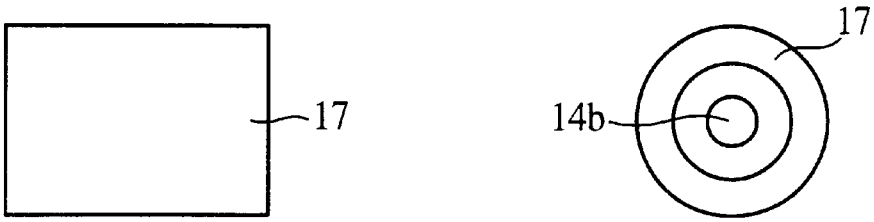
FIG. 5 shows side and sectional views of a water hammer absorbing member according to a fourth embodiment of the present invention.

FIG. 5 shows side and sectional views of a water hammer absorbing member according to a fourth embodiment of the present invention. In FIG. 5, a water hammer absorbing member 17 is formed in the shape of a circular cylinder from a spongy elastic material, e.g. a synthetic rubber, a synthetic resin, a polymer, or an elastomer. The water hammer absorbing member 17 is installed in such a manner that the needle portion 14*b* of the needle valve 14 extends through the center of the cylindrical configuration of the water hammer absorbing member 17.

Next, the operation of the fuel injection valve according to one embodiment of the present invention will be described. In FIG. 1, fuel enters the fuel passage 12*a* of the retainer 12 after dust has been removed therefrom through the filter 10. After passing through the fuel passage 12*a*, the fuel passes through the fuel passage 7*a* of the stator 7, the fuel passage 13*b* of the armature 13, the communicating hole 13*c* and the space 5*b* in the nozzle 5, thereby filling the fuel passage with the high-pressure fuel up to the valve seat 5*a*. When power is applied to the terminal 9, the coil 8*b* is excited, causing the armature 13 to be attracted to the stator 7. Consequently, the valve portion 14*a* separates from the valve seat 5*a* to open the injection hole 5*c*. Thus, fuel injection is performed. When the supply of power to the terminal 9 is cut off, the coil 8*b* is de-excited. Consequently, the armature 13, which is constantly pressed by the spring 11, returns to the previous position. Thus, the valve portion 14*a* abuts on the valve seat 5*a* to close the injection hole 5*c*. At this time, the sudden closing of the valve portion 14*a* causes a steep rise of fuel pressure in the vicinities of the valve seat 5*a* due to a water hammer action. The resulting high-pressure wave goes upstream through the fuel passage. However, the high-pressure wave is weakened by being absorbed and damped through the water hammer absorbing member fitted in the space 5*b*.

The operation of the water hammer absorbing member will be described below in detail.

Figure 6:
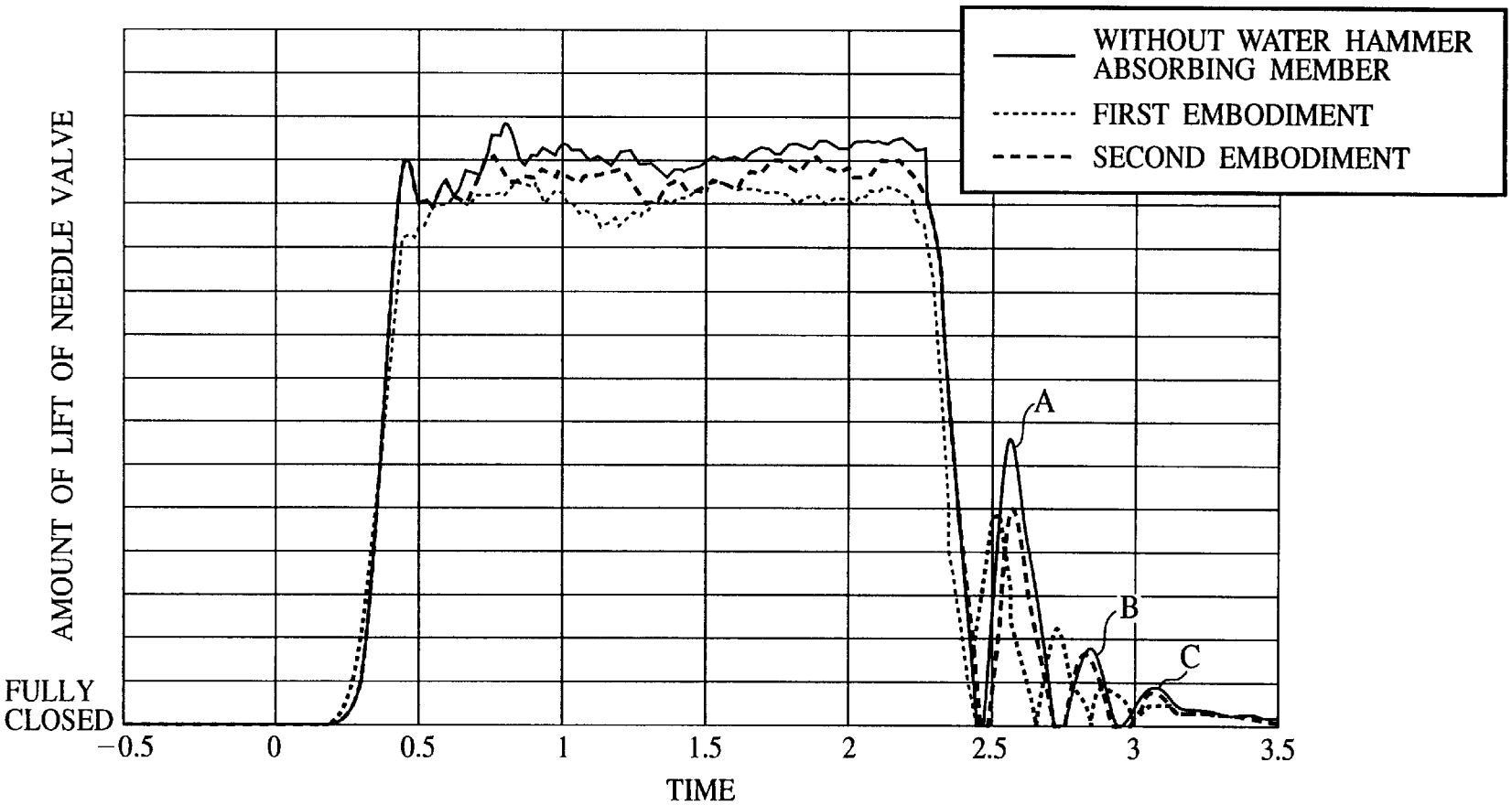
FIG. 6 is a graph comparatively showing the amount of lift of a needle valve in relation to the time elapsed.
Figure 7:
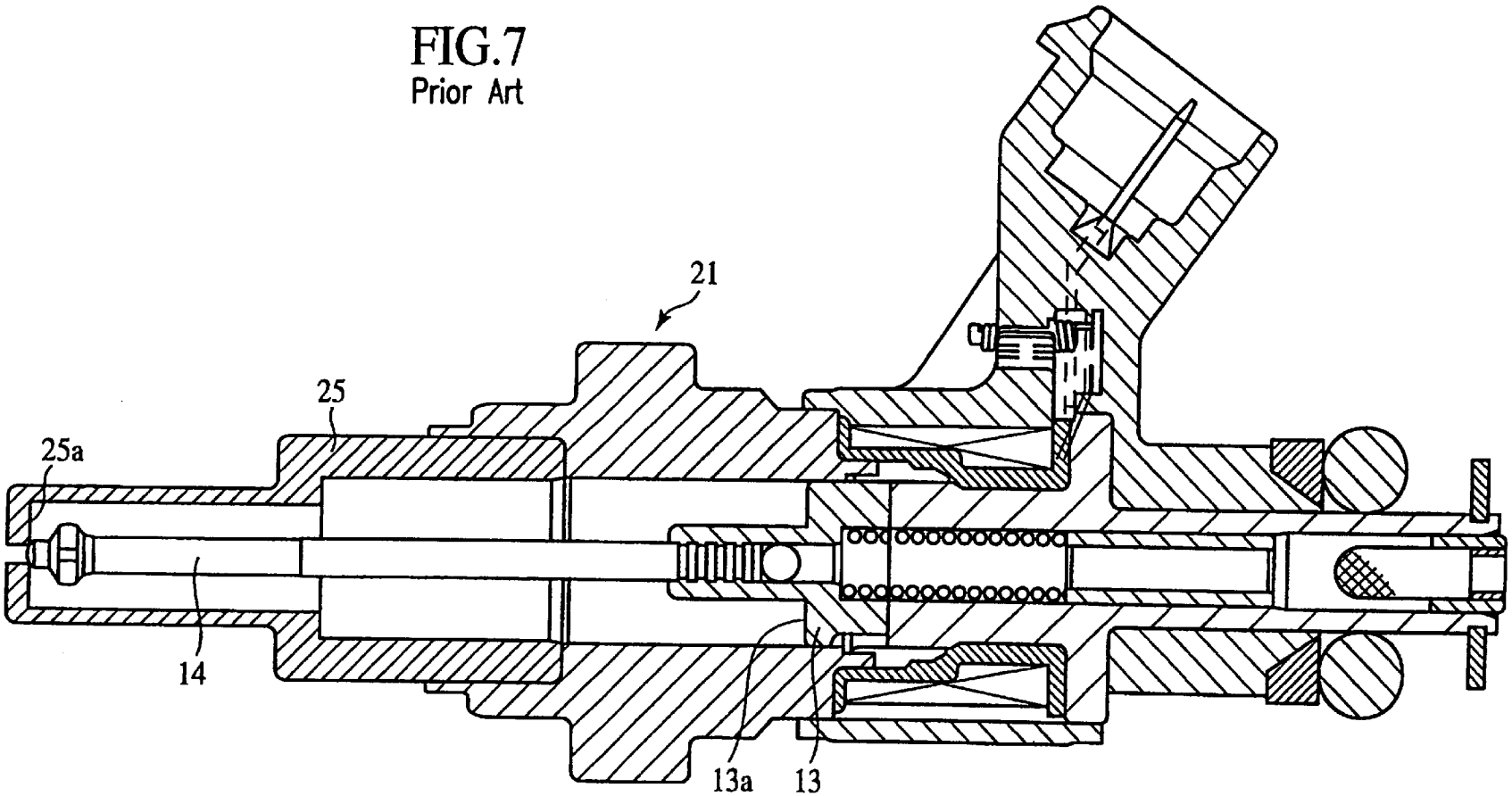
FIG.7 Prior Art
FIG. 7 is a longitudinal sectional view of a conventional fuel injection valve.

In the first embodiment shown in FIG. 2, the high-pressure wave produced by the water hammer action goes upstream through the center of the water hammer absorbing member 6. At this time, the metallic sheet constituting the hexagonal cylinder 6*a* and the fins 6*b* is elastically deformed by the high-pressure wave. Consequently, the high-pressure wave is absorbed and damped by deflection of the metallic sheet and thus weakened. The thin dotted line in FIG. 6 represents the actual behavior of the needle valve 14. The graph of FIG. 6 shows that the bouncing is reduced by the first embodiment of the present invention in comparison to the prior art (without a water hammer absorbing member).

In the second embodiment shown in FIG. 3, the high-pressure wave produced by the water hammer action goes upstream through the center of the water hammer absorbing member 15. At this time, the high-pressure wave attenuates by being echoed in the metallic mesh wound a plurality of turns into a circular cylinder. Thus, the high-pressure wave is weakened by being absorbed and damped through the water hammer absorbing member 15. The thick dotted line in FIG. 6 represents the actual behavior of the needle valve 14. The graph of FIG. 6 shows that the bouncing is reduced by the second embodiment of the present invention in comparison to the prior art (without a water hammer absorbing member).

In the third embodiment shown in FIG. 4, the high-pressure wave produced by the water hammer action goes upstream through the center of the water hammer absorbing member 16. At this time, the high-pressure wave is absorbed and damped by deflection of the synthetic rubber formed in the shape of a circular cylinder. Thus, the high-pressure wave is satisfactorily weakened.

In the fourth embodiment shown in FIG. 5, the high-pressure wave produced by the water hammer action goes upstream through the center of the water hammer absorbing member 17. At this time, the high-pressure wave is absorbed and damped by deflection of the spongy elastic material formed in the shape of a circular cylinder. In addition, the high-pressure wave attenuates by being echoed in cavities formed in the spongy elastic material. Thus, the high-pressure wave is weakened by being absorbed and damped through the water hammer absorbing member 17.

As has been stated above, the high-pressure wave going upstream through the fuel passage is absorbed and damped by the water hammer absorbing member. Therefore, the pressure wave propagated to the armature 13 (see FIG. 1) is reduced. Consequently, the amount of lift of the needle valve 14 is reduced favorably.

It should be noted that the present invention is not limited to the foregoing embodiments but can be modified in a variety of ways.

What is claimed is:

1. A fuel injection valve wherein a needle valve integrally secured to an armature is lifted by excitation of an electromagnetic coil to inject fuel into a combustion chamber from an injection hole formed in a nozzle, said fuel injection valve comprising:

a water hammer absorbing member provided between said armature and said injection hole to absorb a water hammer pressure wave produced by sudden closing of said needle valve, wherein said water hammer absorbing member is a metallic mesh wound a plurality of turns into a circular cylinder.

* * * * *